United States Patent [19]

Amtmann et al.

[11] 4,368,537

[45] Jan. 11, 1983

[54] X-RAY DIAGNOSTIC GENERATOR IN WHICH THE X-RAY TUBE VOLTAGE IS ADJUSTED VIA THE X-RAY TUBE CURRENT

[75] Inventors: Heribert Amtmann, Langensendelbach; Hermann Forkel, Buckenhof; Hans-Jürgen Gerlach, Erlangen, all of Fed. Rep. of Germany

[73] Assignee: Siemens Aktiengesellschaft, Berlin & Munich, Fed. Rep. of Germany

[21] Appl. No.: 247,840

[22] Filed: Mar. 26, 1981

[30] Foreign Application Priority Data

Apr. 18, 1980 [DE] Fed. Rep. of Germany ..... 3015039

[51] Int. Cl.[3] ..... H05G 1/32

[52] U.S. Cl. ..... 378/112

[58] Field of Search ..... 250/409, 408; 378/111, 378/112

[56] References Cited

U.S. PATENT DOCUMENTS 3,846,633 11/1974 Romandi ..... 250/408

4,171,487 10/1979 Amtmann et al. ..... 250/408

FOREIGN PATENT DOCUMENTS 1137144 9/1962 Fed. Rep. of Germany .

1144409 2/1963 Fed. Rep. of Germany ..... 250/409

*Primary Examiner*—Alfred E. Smith

*Assistant Examiner*—T. N. Grigsby

*Attorney, Agent, or Firm*—Hill, Van Santen, Steadman, Chiara & Simpson

[57] ABSTRACT

In an exemplary embodiment in order to establish the desired relationship between x-ray tube voltage and x-ray tube current, at least one series resistance is connected in the power path between the mains and the x-ray tube. A switching device for by-passing the series resistance is present which is controlled by a comparator for the actual value and setpoint value of the x-ray tube voltage in such a fashion that the series resistance is by-passed at the commencement of a radiograph as long as the actual value is smaller than the setpoint value.

1 Claim, 1 Drawing Figure

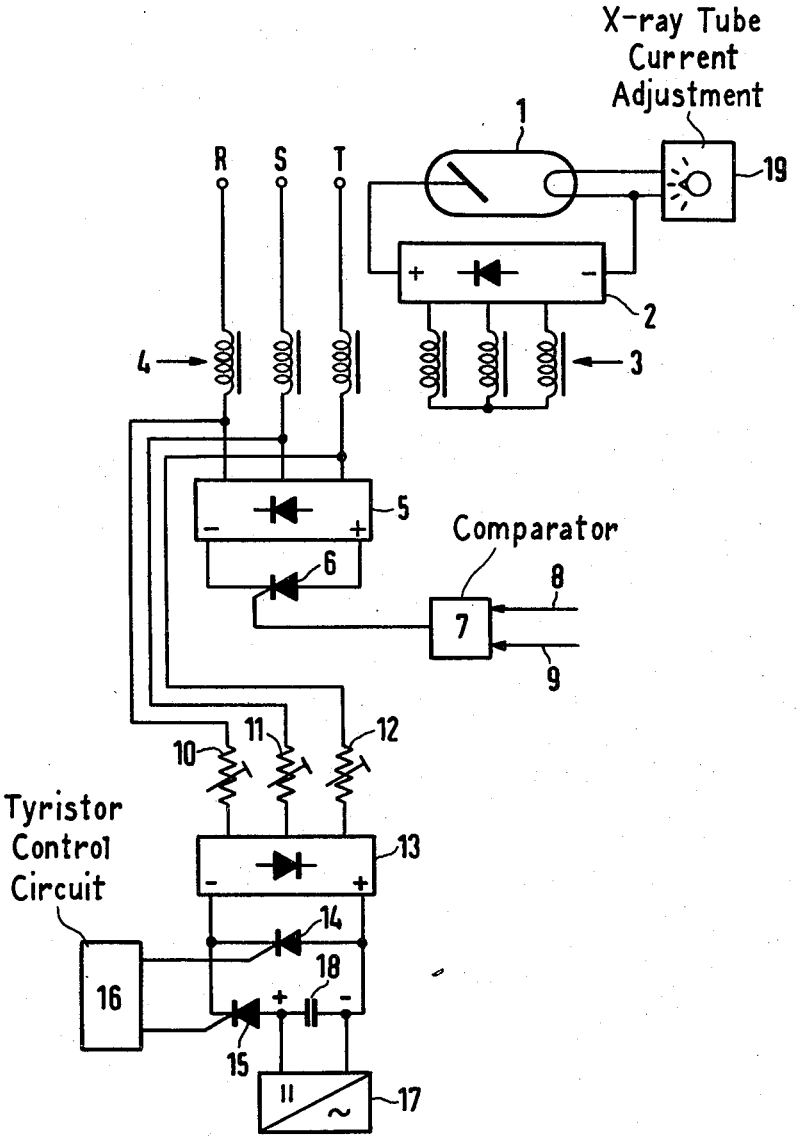
X-ray Tube
Current
Adjustment
1
R
S
T
19
2
4
3
5
Comparator
6
8
7
9
10
11
12
Tyristor
Control
Circuit
13
14
16
18
15
17

X-RAY DIAGNOSTIC GENERATOR IN WHICH THE X-RAY TUBE VOLTAGE IS ADJUSTED VIA THE X-RAY TUBE CURRENT

BACKGROUND OF THE INVENTION

The invention relates to an x-ray diagnostic generator in which the x-ray tube voltage is adjustable via the x-ray tube current, and hence via the voltage drop at the generator internal resistance, and, for establishing the respective voltage versus current relationships (load lines), at least one series resistance is connected in the power path between the mains and the x-ray tube, and in which means are present for switching the x-ray tube on and off.

An x-ray diagnostic generator of this type is described, for example, in the German AS No. 1,137,144. In modern x-ray diagnostics the demand exists for making possible the briefest possible switching times; i.e., the briefest possible radiographs. However, in the case of an x-ray diagnostic generator of the cited type, downward limits are set on the switching time by the series resistance, which establishes the dependency of the x-ray tube voltage upon the x-ray tube current. The series resistance, namely prolongs the leading edge of the x-ray tube voltage and hence the briefest possible switching time. Accordingly, in this instance, very brief switching times are possible only in the case of high power and, accordingly, low series resistance.

SUMMARY OF THE INVENTION

The object underlying the invention resides in designing an x-ray diagnostic generator of the type initially cited such that brief switching times are possible also in the case of low x-ray tube power.

In accordance with the invention, this object is achieved by means of a switching device for by-passing the series resistance. This switching device can be controlled by a comparator which compares the actual and setpoint values of the x-ray tube voltage in such a fashion that the series resistance is by-passed at the commencement of a radiograph as long as the actual value is smaller than the setpoint value. A very brief rise time, and hence also a brief switching time is thereby obtained at the commencement of a radiograph.

The invention shall be explained in greater detail in the following on the basis of an exemplary embodiment illustrated on the accompanying drawing sheet; and other objects, features and advantages will be apparent from this detailed disclosure and from the appended claims.

BRIEF DESCRIPTION OF THE DRAWINGS

The single FIGURE is an electric circuit diagram for illustrating an exemplary embodiment of the invention.

DETAILED DESCRIPTION

In the drawing, an x-ray tube 1 is illustrated which is supplied by a high voltage rectifier 2 which is connected to the secondary winding group 3 of a three-phase high voltage transformer. The primary winding group 4 of the three-phase high voltage transformer is connected to the three-phase mains network. The primary circuit may be completed via a three-phase rectifier 5 whose D.C. current branch is capable of being short circuited by a thyristor 6. The thyristor 6 is controlled by a comparator 7 having an input 8 for receiving an actual value signal corresponding to the x-ray tube voltage, and having an input 9 for receiving a setpoint value signal corresponding to the desired x-ray tube voltage.

Connected in parallel with the three-phase rectifier 5 having the thyristor 6, is a network comprised of three-series resistances 10, 11 and 12 and a three-phase rectifier 13, whose D.C. current branch is capable of being short circuited by a thyristor switching device comprising a main thyristor 14 and a quenching thyristor 15. The thyristors 14 and 15 are controlled by a control device 16 which establishes the switch-on time of the x-ray tube 1. In order to quench the main thyristor 14. the quenching thyristor 15 is ignited, so that a commutation capacitor 18, charged with the indicated polarity by means of a D.C. voltage source 17, assumes the load current.

In the illustrated x-ray diagnostic generator, the x-ray tube voltage is established by the x-ray tube current; namely, by an adjustment device 19 for adjusting the x-ray tube current. In the case of the high-impedance condition of thyristor 6, the components 10 through 18 are operative so that the voltage at the x-ray tube is dependent upon the voltage drop at the series resistances 10, 11 and 12, and hence upon the x-ray tube current, corresponding to a straight line dependency of the x-ray tube voltage upon the x-ray tube current. The respective straight line can be selected by altering the series resistances 10, 11 and 12.

For the attainment of brief switching times; namely, brief leading edges of the x-ray tube voltage, at the commencement of the switching-on of the x-ray tube 1, the components 10 through 15 are by-passed by ignition of the thyristor 6 by means of the comparator 7. This results in maximum power during the voltage rise, and hence results in a brief rise time. The thyristor 6 is ignited during the voltage rise at the x-ray tube as long as the actual value of the x-ray tube voltage is smaller than the setpoint value. As soon as the actual value attains the setpoint value, the thyristor 6 is quenched, such that the thyristor 14 is operative and the radiograph can terminate when the control device 16 delivers a corresponding signal.

It will be apparent that many modifications and variations may be effected without departing from the scope of the novel concepts and teachings of the present invention.

SUPPLEMENTARY DISCUSSION

It will be understood from the foregoing that with thyristor 6 in a low impedance (conducting) condition (i.e. with input 9 of comparator 7 at a higher potential than input 8), primary energizing current from the three phase source connected to terminals R, S, T in the FIGURE will flow via thyristor 6. Thus even though thyristor 14 is also turned on at the start of an exposure, only a negligible current flows in resistances 10, 11, 12, and the power supplied to secondary windings 3 will be at a maximum. When the actual x-ray high voltage (e.g. as measured by a voltage divider connected between the anode and cathode of the x-ray tube 1 and having a fixed low voltage tap connected with input 8 of comparator 7) reaches a setpoint value (e.g. as adjusted by means of a potentiometer energized by a constant D.C. voltage source and having its adjustable tap connected with input 9 of comparator 7), the comparator 7 switches thyristor 6 to the high impedance (quenched) condition, and the operating characteristics of the high voltage generator are controlled by the selected values of resistances 10, 11, 12. An exposure can be terminated by quenching thyristor 14.

The comparator 7 may have its output controlling a quenching circuit for thyristor 6, corresponding to the control by component 16 of the quenching circuit 15, 17, 18 for thyristor 14. The thyristor 6 once quenched may remain quenched regardless of the actual value of the x-ray tube anode voltage (e.g. the turn-on circuit for thyristor 6 can only be reset and again placed under the control of comparator 7 after a quenching operation, by actuation of the exposure button to initiate a new x-ray exposure).

We claim as our invention:

1. An x-ray diagnostic generator comprising an x-ray tube whose voltage is adjustable via means for adjusting the x-ray tube filament current, power supply means having series resistance means in a power supply path between the mains and the x-ray tube for determining the relationship between x-ray tube voltage and x-ray tube current, means for switching the x-ray tube on and off, characterized by a switching device (5, 6), for the purpose of by-passng the series resistance means (10, 11, 12), and characterized in that a comparator (7) controls the switching device (5, 6), said comparator (7) having respective inputs for receiving an actual value signal and a setpoint signal in accordance with an actual value and a setpoint value for the x-ray tube voltage, and said comparator (7) controlling said switching device (5, 6) such that the series resistance means (10, 11, 12) is by-passed at the commencement of a radiograph as long as the actual value is smaller than the setpoint value.

* * * * *